US008742927B2

(12) United States Patent
Olivier

(10) Patent No.: US 8,742,927 B2
(45) Date of Patent: Jun. 3, 2014

(54) METHOD FOR MONITORING AUTHORIZED AND UNAUTHORIZED PERSONS WITHIN A SECURITY PERIMETER AROUND AN APPARATUS

(75) Inventor: Pujol Olivier, Montaigut sur Save (FR)

(73) Assignee: Airbus Operations SAS, Toulouse (FR)

( * ) Notice: Subject to any disclaimer, the term of this patent is extended or adjusted under 35 U.S.C. 154(b) by 1115 days.

(21) Appl. No.: 12/525,072

(22) PCT Filed: Jan. 29, 2008

(86) PCT No.: PCT/FR2008/000103

§ 371 (c)(1),
(2), (4) Date: Nov. 12, 2009

(87) PCT Pub. No.: WO2008/110683

PCT Pub. Date: Sep. 18, 2008

(65) Prior Publication Data

US 2010/0090829 A1 Apr. 15, 2010

(30) Foreign Application Priority Data

Jan. 29, 2007 (FR) ..... 07 52945

(51) Int. Cl.

| | |
|---|---|
| ***G08B 13/00*** | (2006.01) |
| ***G05B 19/00*** | (2006.01) |
| ***G05B 23/00*** | (2006.01) |
| ***H04B 1/00*** | (2006.01) |
| ***G08B 21/00*** | (2006.01) |
| ***G05D 1/00*** | (2006.01) |
| ***G06F 19/00*** | (2011.01) |
| ***G01C 17/38*** | (2006.01) |
| ***G05D 1/12*** | (2006.01) |

(52) U.S. Cl.

USPC ..... 340/541; 340/5.81; 340/5.82; 340/5.53; 340/945; 340/540; 701/7; 701/120; 701/528; 244/183; 244/192

(58) Field of Classification Search

CPC ..... G08B 23/00; G08B 29/00; G08B 31/00; G08B 2001/00; G08B 13/19697; G08B 13/1965; G08B 13/2494; G08B 13/19647; G07C 5/00; G07C 2009/00; G07C 2009/00007; G07C 9/00; G07C 11/00; G08G 5/00; G08G 5/0047; G08G 5/0043; G08G 7/02; G08G 5/0004; G08G 5/02; G08G 5/045; B64D 2045/00; B64D 2045/0085; B64D 2205/00; B64D 1/00; B64D 2009/00; B64D 2201/00; B64D 2203/00; B64D 2045/004; B64D 43/00; B64D 45/04; B64D 47/02; B64D 45/00; B64D 45/0005; B60R 2225/00; B60R 2300/00; B60R 25/1012

USPC ..... 340/5.2, 5.52, 5.53, 5.8, 5.81, 5.83, 340/541, 945, 963, 5.33, 506, 539.1, 3.1, 340/837, 988; 348/148, 152, 153, 143, 156; 382/115, 118, 209, 218, 124; 705/5, 705/32, 418; 701/3, 9, 14

See application file for complete search history.

(56) References Cited

U.S. PATENT DOCUMENTS 5,933,098 A * 8/1999 Haxton ..... 340/945

(Continued)

FOREIGN PATENT DOCUMENTS

WO WO 02/23498 A1 3/2002

(Continued)

*Primary Examiner* — Jennifer Mehmood
*Assistant Examiner* — Mirza Alam
(74) *Attorney, Agent, or Firm* — Patterson Thuente Pedersen, P.A.

(57) ABSTRACT

The invention relates to the automatic detection of the presence of non-authorized persons in the vicinity of an apparatus of the aircraft type. To this end, the invention comprises equipping persons with radio transmitters for identifying them as authorized personnel. The aircraft are also fitted, such as at the existing PODs, with a transceiver device of a radio identification system of the RFID type for recognition of the persons wearing the radio transmitters. Only the persons who are not authorized in the vicinity of the aircraft initiate an alarm procedure.

16 Claims, 2 Drawing Sheets

(56) References Cited

U.S. PATENT DOCUMENTS

| | | | | |
|---|---|---|---|---|
| 6,294,997 | B1 * | 9/2001 | Paratore et al. | 340/572.1 |
| 6,545,601 | B1 | 4/2003 | Monroe | |
| 6,658,572 | B1 * | 12/2003 | Craig | 726/16 |
| 7,561,037 | B1 * | 7/2009 | Monroe | 340/521 |
| 2003/0034876 | A1 * | 2/2003 | Puchek et al. | 340/5.53 |
| 2003/0067542 | A1 * | 4/2003 | Monroe | 348/148 |
| 2003/0071743 | A1 * | 4/2003 | Seah et al. | 340/945 |
| 2005/0110610 | A1 * | 5/2005 | Bazakos et al. | 340/5.82 |
| 2006/0074986 | A1 * | 4/2006 | Mallalieu et al. | 707/104.1 |
| 2008/0149763 | A1 * | 6/2008 | Wakayama et al. | 244/118.1 |

FOREIGN PATENT DOCUMENTS

| | | | |
|---|---|---|---|
| WO | WO 2004/051590 | A2 | 6/2004 |
| WO | WO 2004/068432 | A1 | 8/2004 |
| WO | WO 2007/051955 | A1 | 5/2007 |

* cited by examiner

METHOD FOR MONITORING AUTHORIZED AND UNAUTHORIZED PERSONS WITHIN A SECURITY PERIMETER AROUND AN APPARATUS

PRIORITY CLAIM

The present application is a national stage entry of PCT Application No. PCT/FR2008/000103, filed Jan. 29, 2008 which claims priority from French Application No. 072945, filed Jan. 29, 2007, the disclosures of which are hereby incorporated by reference in their entirety.

TECHNICAL FIELD

The field of the invention is, in a general manner, that of aircraft security, and more particularly, that of the monitoring of their integrity during stopovers outside of their base.

BACKGROUND

From the very beginning, security has played an integral role in the world of aeronautics. Aircraft manufacturers and airlines have progressively developed and integrated a certain number of operations aiming at improving safety onboard aircraft.

From the aircraft manufacturer's point of view, armoured cockpit doors, video-surveillance inside the airplane, or even the protection of information systems on-board against possible computer hacking operations can be cited in particular.

Airlines have taken a certain number of measures such as, for example, the presence of a sky marshal on-board, the training of personnel consisting of learning how to manage aircraft hijacking or even provisions for the safety of the aircraft on the ground. These provisions consist in particular of ensuring that the airplane is intact after having spent a night outside of its base: the external hatches, doors and maintenance panels must be checked in order to determine if anyone has entered the airplane during the night or if they have placed a bomb inside the airplane. There are numerous methods which enable the integrity of the airplane to be verified, in particular:

- pelletizing, which consists of placing seals on all of the external openings in the evening, after the disembarkation of passengers and personnel; the following day, someone in charge of the ground security checks the condition of these seals, however this method is fastidious and above all unreliable, as these seals can be fairly easily replaced without any visible indications;
- the on-board video-surveillance, adapted to particular situations and using a set of cameras as well as a detection device by radar and/or infrared sensors; this method being described in more detail below.

The airplanes are, in certain cases, parked in areas where monitoring is tricky or even difficult; security, very expensive, can even be completely inefficient. In this last example, the best solution remains video-surveillance.

The best solution for video-surveillance to be present in all of the airports where the airplane is stopping, is to have at least one camera on the external surface of the airplane's fuselage.

Conventionally, there exists a POD-type container which fulfils the video-surveillance of an airplane function. The POD is a container attached to the underside of an apparatus in order to place different devices on the apparatus, such as, for example, cameras.

FIGS. 1 and 2 represent such a device; FIG. 3 shows the different view points taken from such a POD; FIG. 4 represents an overall view of the airplane considered.

FIG. 1 shows an overall close-up view of a POD 100 installed on belly fairing 103 of the airplane. POD 100 includes in particular:

- a set of four infrared-type cameras 101A, 101B, 101C and 101D placed in such a way that their central axes are perpendicular to each other and parallel to the plane defined by the floor, with the purpose of having a horizontal line of vision, 360 degrees around the airplane; as a result, cameras 101C and 101D are not visible on this view from the perspective of POD 100.
- a radar 102 placed in its centre, capable of detecting movements near airplane 102.

In other modes of embodiment of this device, infrared sensors detect movements in the dark. The radar and/or sensors order cameras 101A, 101B, 101C and 101D to start a video recording when they detect movements near airplane 102.

FIG. 2 shows an overall distant view of POD 100 installed on belly fairing 103 of the airplane.

FIG. 3 shows the four view points 300A, 300B, 300C and 300D captured by cameras 101A, 101B, 101C and 101D, respectively. The central axis of camera 101A is orientated towards the front part of the airplane. The central axis of camera 101B is orientated towards the left-hand wing of the airplane. The central axis of camera 101C, not represented on FIG. 1 but represented on FIG. 4, is orientated towards the rear part of the airplane. The central axis of camera 101D, not represented on FIG. 1 but represented on FIG. 4, is orientated towards the right-hand wing of the airplane.

FIG. 4 represents an overall aerial view of the airplane equipped with POD 100. The airplane considered is in the center of a security perimeter 401, circular in shape. When an individual 402 intrudes 403 in secured area 401, radar 102 detects a movement 404, which activates the video recording of cameras 101A, 101B, 101C and 101D, and simultaneously triggers the sending of an alarm message 405 to a security station 406.

This type of video-surveillance is suitable for situations where there is very little traffic around the aircraft. A major problem therefore occurs when the airplane stops over in a large airport where numerous people are circulating: all of the persons penetrating security perimeter 401 activate an alarm, even though the majority have authorization to do so, which generates a large quantity of information which is difficult to analyze.

SUMMARY

Embodiments of the invention address the problems described above. In particular, the invention proposes that an alarm procedure is only automatically activated in the event of the presence of unauthorized persons near the aircraft. To this effect, the invention proposes fitting people with radio-transmitters enabling them to be identified as authorized personnel. The airplanes will thus advantageously be fitted, at the level of the existing PODs, with a transceiver device of an RFID-type radio identification system enabling those persons wearing radio-transmitters to be recognized. Only those persons not authorized to be near the aircraft will thus activate the alarm procedure.

The invention therefore relates to a method for monitoring authorized and unauthorized persons present within a determined security perimeter around an apparatus, the method including detecting, by a detection system, a person entering the security perimeter, wherein an additional checking of the person detected for the presence of a radio frequency identification tag for a radio identification system including a transceiver device in or on the apparatus is carried out.

In an embodiment, the method according to the invention can include one or more additional features, such as activating an alarm procedure in the absence of a radio frequency identification tag on the person detected. In an embodiment, checking additionally includes verifying the validity of the information communicated by the radio frequency identification tag; and activating the alarm procedure if the information is not valid. In an embodiment, verifying the validity of the radio frequency identification tag includes different operations, such as comparing data stored in the radio frequency identification tag with data stored in a database of the radio identification system, the data relating to an identity and/or time slot for authorized presence and/or a duration of authorized presence, and/or an authorized sub-area of the security perimeter.

In an embodiment, the detection system includes at least one radar device, the radar device and the transceiver device operating at different frequencies. In an embodiment, the transceiver device and the detection system are placed in the same housing.

In an embodiment, the method includes bijectively coupling each radio frequency identification tag with an access badge, including different rights, for each person authorized to penetrate the security perimeter.

In an embodiment, the alarm procedure includes activating a video recording of the person detected. In an embodiment, the video recording is recorded onto a hard disk onboard the aircraft. In an embodiment, the alarm procedure includes automatically transmitting the video to surveillance means outside of the security perimeter. In an embodiment, the alarm procedure includes communicating an alarm message to the surveillance means. In an embodiment, the alarm procedure includes activating an audible alarm.

Any combination of these and other characteristics provided that they do not conflict, constitutes a possible implementation mode of the invention.

The invention also relates to apparatus for monitoring persons authorized and not authorized to be present within a determined security perimeter around an aircraft-type apparatus, including at least one device for detecting the persons present within the security perimeter, and further comprising a transceiver device for an RFID-type radio identification system capable of detecting the presence of radio frequency identification tags within a secured area.

In embodiments, the apparatus can present one or more additional characteristics, such as being positioned on the belly fairing of the aircraft. In an embodiment, he detection device and the transceiver device operate with different frequencies.

BRIEF DESCRIPTION OF THE DRAWINGS

The invention may be more completely understood in consideration of the following detailed description of various embodiments of the invention in connection with the accompanying drawings, which are not limiting and in which.

DETAILED DESCRIPTION

Figure 1:
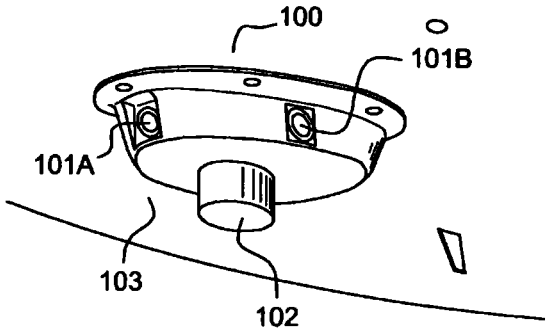
FIG. 1 is an overall close-up view of a conventional POD-type container.
Figure 2:
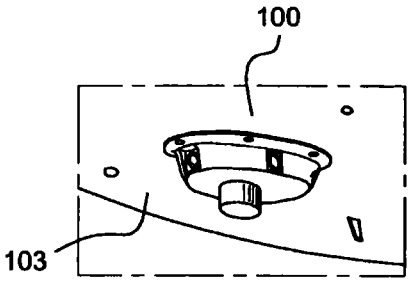
FIG. 2 is an overall distant view of the POD of FIG. 1.
Figure 3:
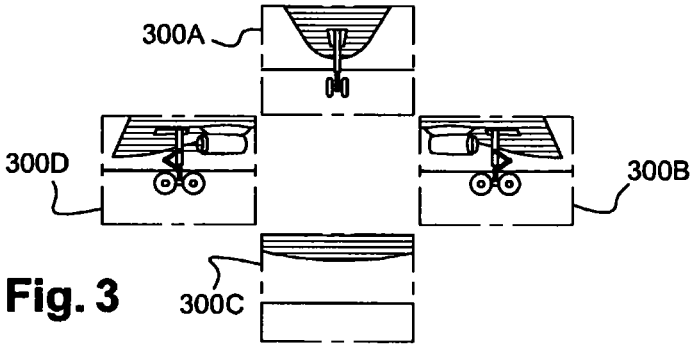
FIG. 3 depicts various views obtainable by the POD of FIG. 1.
Figure 4:
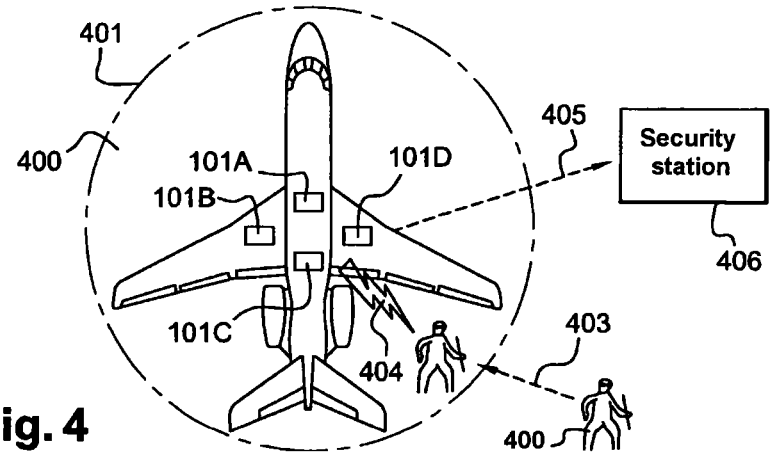
FIG. 4 is an overall aerial view of an airplane.

This invention relates to a method for monitoring persons authorized and not authorized to be present within a determined security perimeter around an aircraft-type apparatus. It also relates to a device capable of implementing such a method.

The overall purpose of the invention is to authorize personnel, designed to act on an airplace during its stopovers, to penetrate and work without activating an alarm procedure in a secured area; for unauthorised personnel, an alarm procedure is activated, for example by recording, by means of video-surveillance cameras, a scene showing the intrusion of the unauthorised personnel.

Before entering into details of embodiments of the invention, general principles of RFID-type radio identification systems will be summarized.

Radio identification, originating from the English Radio Frequency Identification (usually shortened to RFID), is a method for storing and recovering data remotely by using markers known as "radio frequency identification tags"; these are small objects which can be attached to or incorporated into products. The radio frequency identification tags include an antenna connected to an electronic chip which enables them to receive and reply to radio transmitted requests from the transceiver device. These electronic chips can include an EPC-type identification (Electronic Product Code).

The reader sends a particular interrogation signal to which the tag replies. One of the simplest possible replies is the sending of a digital identification, for example that of the standard EPC-96 which uses 96 bits. A table or a database, which can be placed onboard a monitored vehicle, can thus be consulted in order to ensure, for example, monitored access or count. The marker is extremely discrete by its sleekness, its size being reduced to a few millimetres and its weight negligible. With its cost being minimal, it can be made disposable, even though reuse would be advantageous from an ecological point of view.

In an embodiment, an RFID tag comprises an antenna, a silicon chip and a substrate and/or an encapsulation. Three types of radio frequency identification tags can be identified:

- Passive radio frequency identification tags, which do not require any source of energy outside of that provided by the readers at the time of interrogation, not including in principle a battery.
- Active radio frequency identification tags are equipped with a battery enabling them to emit a signal. Because of this, active tags can be read from far away, unlike passive tags. However, an active emission of information signals the presence of radio frequency identification tags to anyone, and poses questions regarding security.
- Semi-active radio frequency identification tags do not use a battery to emit signals. They act as passive tags with respect to communication. However, a battery enables them, for example, to record data during transport.

Referring to the drawings, like elements use like reference numerals, unless stated otherwise.

Figure 5:
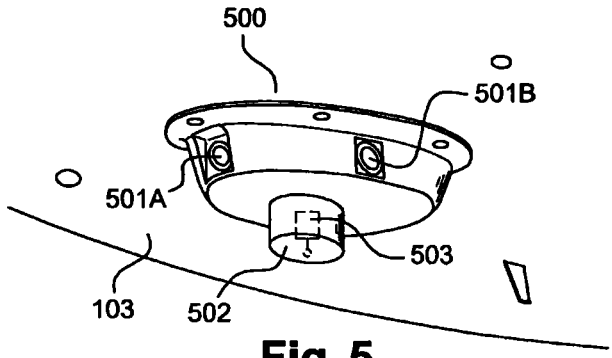
FIG. 5 is an overall close-up view of a POD-type apparatus according to an embodiment.

FIG. 5 is an overall close-up view of a POD-type apparatus 500 according to an embodiment, installed on a belly fairing 103 of an airplane, i.e. the lower part of the airplane's fuselage. In an embodiment, POD 500 includes an overall view of four infrared-type cameras 501A, 501B, 501C and 501D, placed in such a way that their central axes are perpendicular to each other and parallel to the plane defined by the floor, with the purpose of having a horizontal line of vision, 360 degrees around the airplane; as a result, cameras 501C and 501D are not visible on this view from the perspective of POD 500. POD 500 can also include a radar 502 placed at or near the center of POD 500 and capable of detecting movements near airplane 102. POD 500 can also include an RFID transceiver device as previously described, capable of communicating with radio frequency identification tags, each tag bijectively coupled with an access badge, including different rights, for any person authorized to penetrate the security perimeter.

In other embodiments of the method, several RFID transceiver devices can be positioned at different places on the airplane in order to increase the scope of the surveillance according to the method and/or to distinguish, in security perimeter 401, different secured areas, for example the luggage area, the turboreactors area, etc. In such an example, a radio frequency identification tag can thus authorize access only to certain secured areas.

In another embodiment of POD 500, infrared sensors detect movements in the dark. The radar and/or sensors order cameras 503A, 503B, 503C and 503D to start a video recording when one or more of the cameras detect movements from unauthorized persons near airplane 102.

Figure 6:
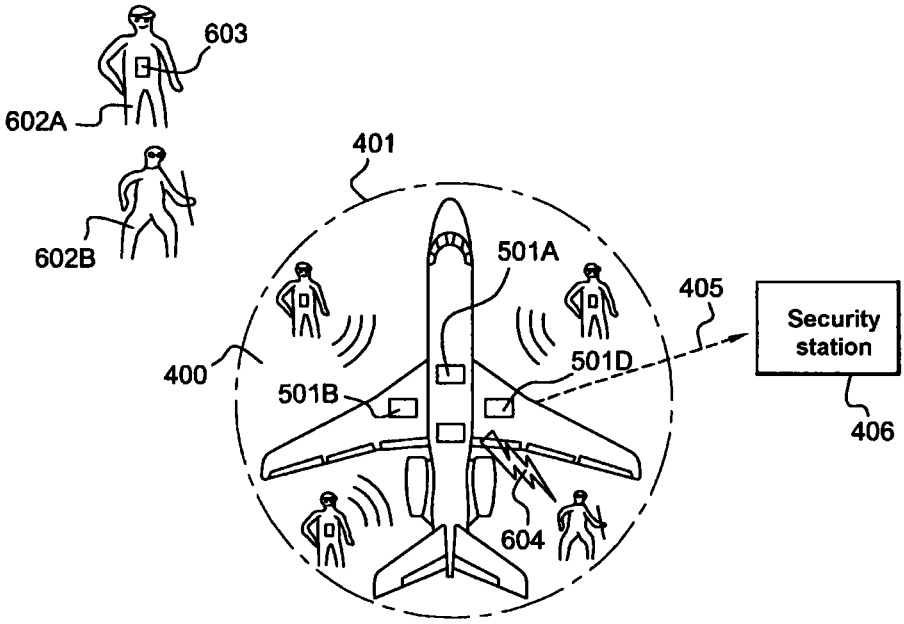
FIG. 6 is an overall aerial view of an airplane equipped with a POD-type apparatus according to an embodiment.

FIG. 6 represents an overall aerial view of an airplane equipped with POD 500. The airplane considered is in the center of a secured area 401, circular in shape. The method according to an embodiment can distinguish between two categories of individuals: technicians 602A wearing a badge fitted with radio frequency identification tag 603, authorized to penetrate area 401 without surveillance; and individuals 602B not wearing a radio frequency identification tag 603, forbidden to access the area.

When radar 502 detects an intrusion of a technician 602A in perimeter 401 of secured area 400, RFID transceiver device 503 transmits a radio request to radio frequency identification tag 603, which sends a message identifying the technician so as not to activate a video recording.

When radar 502 detects an intrusion of an unauthorized individual 602B in perimeter 401 of secured area 400, RFID transceiver device 503 transmits a radio request without reply due to the absence of a radio frequency identification tag 603. An alarm procedure is thus activated. In one example, this procedure includes a video recording and the sending of an alarm message 405 to surveillance means outside of security perimeter 401, such as a security station 406.

In one example, when radar 502 detects an intrusion of an individual, the method can include comparing the identity data stored in the radio frequency identification tag with identity data stored in a database of the radio identification system. This database can be placed onboard the airplane for security reasons.

In other embodiments of the method, the data compared relates to a time slot for authorized presence and/or a duration of authorized presence, and/or an authorized sub-area of the security perimeter.

Radar 502 and transceiver 503 operate on different frequencies in order to avoid any electromagnetic interference. Typically, the frequency bandwidth used by the radar for short broadcast ranges, such as airport ground surveillance, is between about 27 and 40 GHz; the frequency used for radio identification is generally lower than about 27 GHz.

In some embodiments of the method, the alarm procedure can include a telephone call to security agents or an alarm-type audible or visual signal. On the other hand, surveillance means 406 outside of the security perimeter can be created by a set of monitors or a set of light indicators indicating the status of traffic near the monitored airplanes.

The invention claimed is:

1. A method for monitoring authorized persons and unauthorized persons present within a determined security perimeter around an aircraft, comprising:

detecting by a detection system, a person entering the security perimeter of a secured area, wherein the detection system includes at least one sensor in or on the aircraft that detects movement of the authorized persons and the unauthorized persons within the determined security perimeter;

emitting a radio request if movement is detected, wherein the radio request is an interrogation signal for a radio frequency identification (RFID) tag of a radio identification system, the radio request being emitted from a transceiver device in or on the aircraft;

checking an RFID tag reply to the radio request to determine whether access to the secured area is authorized, wherein checking the RFID tag includes verifying data relating to one or more identities, wherein each identity includes individualized authorization rights to access sub-areas of the security perimeter stored in the RFID tag and in a database of the radio identification system; and activating an alarm procedure where no access is authorized.

2. The method of claim 1, wherein radio requests are emitted with several transceiver devices positioned at different places in or on the aircraft.

3. The method of claim 1, wherein checking includes verifying data contained in a RFID tag reply with data stored in a database of the radio identification system.

4. The method of claim 1, wherein the detection system includes at least one radar, the radar and the transceiver device operating at different frequencies.

5. The method of claim 1, wherein the transceiver device and the detection system are housed together.

6. The method of claim 1, wherein the alarm procedure includes activating a video recording of the person detected.

7. The method of claim 6, wherein the video recording is recorded onto a hard disk onboard the aircraft.

8. The method of claim 6, wherein the alarm procedure includes automatically transmitting the video recording to a location outside of the security perimeter.

9. The method of claim 8, wherein the alarm procedure includes communicating an alarm message to a location outside of the security perimeter.

10. The method of claim 1, wherein the alarm procedure includes activating an audible alarm.

11. An apparatus for monitoring persons authorized and not authorized to be present within a determined security perimeter around an aircraft, comprising:

a detection system, including at least one sensor in or on the aircraft that detects movement of the authorized persons and the unauthorized persons within the determined security perimeter; and a radio identification system, including a transceiver device in or on the aircraft that emits a radio request, wherein the radio request is an interrogation signal for a radio frequency identification (RFID) tag, the radio identification system further checking an RFID tag reply to the radio request to determine whether access to the secured area is authorized and activating an alarm procedure where no access is authorized, wherein checking the RFID tag includes verifying data relating to one or more identities, wherein each identity includes individualized authorization rights to access sub-areas of the security perimeter stored in the RFID tag and in a database of the radio identification system.

12. The apparatus of claim 11, wherein the apparatus is positioned on a belly fairing of the aircraft.

13. The apparatus of claim 11, wherein the detection system includes at least one radar, the at least one radar and the transceiver device operating at different frequencies.

14. The method of claim 3, wherein data relating to at least one of a time slot for authorized presence or a duration of authorized presence is stored in the RFID tag and in the database of the radio identification system.

15. The method of claim 1, wherein different sub-areas are distinguished within the security perimeter.

16. The method of claim 1, wherein the alarm procedure includes initiating a telephone call to a location outside of the security perimeter.

* * * * *